US005122326A

United States Patent [19]

Jackson et al.

[11] Patent Number: 5,122,326

[45] Date of Patent: Jun. 16, 1992

[54] METHOD OF REMOVING BINDER MATERIAL FROM SHAPED ARTICLES UNDER VACUUM PRESSURE CONDITIONS

[75] Inventors: Martha L. Jackson, Boston, Mass.; Elliot Thompson, Coventry, R.I.

[73] Assignee: Vacuum Industries Inc., Sumerville, Mass.

[21] Appl. No.: 20,434

[22] Filed: Mar. 2, 1987

[51] Int. Cl.[5] ..... C04B 38/06

[52] U.S. Cl. ..... 264/102; 264/63; 264/328.2; 264/344; 419/36; 419/37; 419/44; 419/60; 419/65

[58] Field of Search ..... 264/63, 344, 102, 328.2; 419/36, 37, 44, 60, 65

[56] References Cited

U.S. PATENT DOCUMENTS

| | | | |
|---|---|---|---|
| 2,622,024 | 12/1952 | Gurnick et al. | 419/36 |
| 2,939,199 | 6/1960 | Strivens | 264/63 |
| 3,346,680 | 10/1967 | Bush | 264/63 |
| 3,410,684 | 11/1968 | Printz | 419/36 |
| 3,708,285 | 1/1973 | Scheyer | 264/63 |
| 3,711,279 | 1/1973 | Hivert et al. | 419/36 |
| 3,769,044 | 10/1973 | Horton | 264/63 |
| 3,871,630 | 3/1975 | Wanetzly et al. | 419/44 |
| 4,113,480 | 9/1978 | Rivers | 75/214 |
| 4,197,118 | 4/1980 | Wiech, Jr. | 264/63 |
| 4,225,345 | 9/1980 | Adee et al. | 264/63 |
| 4,259,112 | 3/1981 | Dolowy, Jr. et al. | 419/6 |
| 4,305,756 | 12/1981 | Wiech, Jr. | 419/36 |
| 4,374,457 | 2/1983 | Wiech, Jr. | 264/63 |
| 4,388,255 | 6/1983 | Simpson | 264/29.1 |
| 4,404,166 | 9/1983 | Wiech, Jr. | 264/63 |
| 4,415,528 | 11/1983 | Wiech, Jr. | 419/46 |
| 4,445,936 | 5/1984 | Wiech, Jr. | 75/228 |
| 4,465,650 | 8/1984 | Ohno | 264/60 |
| 4,502,871 | 3/1985 | Andersen et al. | 55/82 |
| 4,534,936 | 8/1985 | Carlstrom et al. | 419/36 |
| 4,575,449 | 3/1986 | Lueth | 264/65 |
| 4,579,713 | 4/1986 | Lueth | 419/58 |
| 4,591,481 | 5/1986 | Lueth | 419/26 |

FOREIGN PATENT DOCUMENTS 2005571 9/1970 Fed. Rep. of Germany .

OTHER PUBLICATIONS

*General Chemistry Principles and Structure*, 2nd ed., Brady and Humiston, John Wiley & Sons, Inc., 1978, pp. 241-246.

"Metallurgia and Metal Forming", vol. 42, No. 9, pp. 313-314 (1975).

*Primary Examiner*—James Derrington

*Attorney, Agent, or Firm*—Henry D. Pahl, Jr.

[57] ABSTRACT

The present invention is a method of removing binder material which is non-sublimable at room temperature and pressures greater than 1 Torr from a binder and particulate mixture. The binder and particulate mixture is formed into a shaped article and placed in a closed furnace. The closed furnace is then adjusted to a pressure and temperature sufficient to effect transformation of the binder material from a solid to a vapor and diffusion of the binder material as a vapor through, and from, the binder and particulate mixture without formation of a liquid phase of binder material on the binder and particulate mixture surface. The shaped article is held under these processing conditions until substantially all of the binder material transforms to its vapor state and diffuses through, and from, the mixture into the closed furnace. The binder material vapor is then evacuated from the furnace through conventional means.

1 Claim, 1 Drawing Sheet

METHOD OF REMOVING BINDER MATERIAL FROM SHAPED ARTICLES UNDER VACUUM PRESSURE CONDITIONS

BACKGROUND OF THE INVENTION

The present invention relates to a method of removing binder material from a binder and particulate mixture and more particularly relates to a method of removing binder material from shaped articles under vacuum pressure conditions.

It is well known in the art to form shaped articles of particulate material by injecting a heated particulate and binder mixture into a mold in such a manner that the resulting product retains the shape of the mold upon cooling. Subsequent to ejection from the mold, the shaped mass is sintered to bond the particles together and thereby provide the physical characteristics and stability necessary for the article's intended environment of use. Because the binder material generally consists of low melting point hydrocarbon-based materials, typically waxes, plastics and polymers, the binder material often volatilizes or decomposes prior to sintering into substances which can chemically react and combine with the particulate particles. The effect of such a reaction on the chemical and physical properties of the sintered product is particularly deleterious when the particulate is a metal or metal alloy and the decomposition product contains carbon.

In order to overcome the problems caused by the thermal dissociation of the binder, the prior art has developed several methods for debindering the shaped article prior to the sintering process. Solvent extraction of the binder material is disclosed in U.S. Pat. No. 2,939,199 to Strivens whereby the extraction is carried out by immersing the shaped part in either boiling solvent, hot solvent or solvent vapor. Because of the high temperatures involved in the extraction process, temperature gradients form in the shaped part which can lead to the cracking or fracture of the desired product. Another problem is that solvent extraction techniques can pose a health risk to the employee operating the process. Furthermore, national or state pollution laws may require recovery or treatment of the solvents utilized which can add substantial cost to the binder removal process.

In addition to removing binder materials by solvent extraction, Strivens also disclosed a method of debindering shaped articles through vacuum distillation. The binder is first transformed to its liquid state by melting whereupon it is then removed from the article surface by evaporation. Transformation of the binder from the solid phase to the liquid phase and from the liquid phase to the vapor phase at the surface of the article can lead to distortion of the part being manufactured to such an extent that the required tolerances for the desired application cannot be met.

A method for evaporating binder material from a green body by blowing a non-saturated chemically inert gas or air at atmospheric pressure over the product surface on which liquid binder is present is disclosed in U.S. Pat. No. 4,404,166 to Wiech, Jr. As normally practiced, the flowing gas is air which is known to react and combine with particulate metal and metal materials to produce chemical oxides which can adversely affect the final physical and chemical properties and characteristics of the products. In order to ensure the continuous removal of the liquid binder from the wet surface, the atmosphere adjacent to and in contact with the green body surface must always be maintained in an unsaturated condition. If the flow of the chemically inert atmosphere or air is in any way disturbed or impeded, which can commonly occur during commercial operation, the efficiency of the removal of the binder from the shaped article will be seriously impaired. An additional limitation is that both the expansion and outward migration of the liquid binder from the interior to the surface of the green body generate internal pressure forces which can lead to cracking or distortion of the shaped article.

A method for continuously evaporating binder material from a shaped article is disclosed in U.S. Pat. No. 4,305,756 to Wiech, Jr. The article to be debindered is held in a closed chamber at a pressure many orders of magnitude greater than the vapor pressure of the binder material at the ambient temperature within the chamber. Under these processing parameters, the binder transforms first to the liquid phase and from the liquid phase the binder material is then evaporated into the furnace atmosphere. To enable the continuous distillation of the liquid binder from the green body, Wiech provides for the condensing of the binder vapor onto a cold collecting region. The continuous condensation of binder vapor at the cold region in the furnace creates a driving force for continuing evaporation of the liquid binder. An uncontrolled or nonuniform removal rate will cause the formation of internal pressure gradients in the green body which can lead to cracking or rupture of the shaped article. An additional limitation of this process is that it is very time consuming, requiring at least 12 hours for the removal of a simple paraffin binder.

The sublimation of the first of two binder materials from a powdered metal and binder mixture prior to sintering is disclosed in U.S. Pat. No. 4,225,345 to Adee et al. Removal of the first binder material, which is camphor, takes place at room temperature and at a partial pressure of 10 inches of mercury. Removal of the second binder material, which is either polystyrene or paraffin, is disclosed only as being removed by solvent extraction or thermal decomposition.

The removal of binder material from a shaped article by sublimation is also disclosed in U.S. Pat. No. 3,769,044 to Horton. The two phase binder system consists of a first binder atmospheric pressures, such as camphor or paradichlorobenzene, or which requires slight heating to facilitate sublimation such as anthracene or benzolic acid, and a second binder which is nonsublimable at these temperature and pressure parameters. Sublimation of the sublimable binder is facilitated, if necessary, by subjecting the article to a partial pressure of approximately 27 inches of mercury. Because of the low vacuum or partial pressure conditions which are required, only those binders which naturally sublime at or near room temperature and atmospheric conditions can be utilized. In addition, the Horton process is inordinately time consuming requiring from four to ten hours to remove the camphor or paradichlorobenzene.

Hence, the prior art still lacks a method for removing binder material from a binder and particulate mixture which proceeds at an enhanced rate, does not require formation of a liquid binder phase on the mixture surface which can adversely affect part integrity and which will effectively remove binder materials that are not readily sublimable at room temperature and pressures greater than 1 Torr.

SUMMARY OF THE INVENTION

The present invention is a method of removing at least one binder material which is non-sublimable at room temperature and pressures greater than 1 Torr from a binder and particulate mixture which has been molded into the form of a shaped article (i.e., the term non-sublimable binder is intended throughout the specification and claims to mean a binder that will not detectably sublimate in a matter of days or weeks at room temperature and pressures greater than 1 Torr). In one important embodiment of the invention, the binder and particulate mixture is formed into a shaped article and placed in a closed furnace. The closed furnace is then adjusted to a pressure and temperature sufficient to effect transformation of the binder material from a solid to a vapor and diffusion of the binder material as a vapor through, and from, the shaped article without formation of a liquid binder phase on the binder and particulate mixture surface. The shaped article is held under these processing conditions until substantially all of the binder material vapor has diffused through, and from, the shaped mixture into the vacuum furnace. To avoid chemical reaction between the shaped article and the carbonaceous binder vapor when higher temperatures are encountered, the gaseous binder material is evacuated from the furnace environment through a diffusion pump and a condensing system such as is taught in U.S. Pat. No. 4,502,871.

In another important embodiment of the invention, the binder consists of a first binder material having a first melting point and a second binder material having a second melting point which is higher than the first binder material. Each of the binder materials is non-sublimable at room temperature and pressures greater than 1 Torr so that both room temperature and thermal injection molding processes can be utilized to form the binder and particulate mixture into a shaped article. The injection molded article is held in a vacuum furnace at a pressure and temperature sufficient to effect transformation of the first binder material from a solid to a vapor and diffusion of the first binder material as a vapor through, and from, the shaped article without formation of a liquid phase of the first binder on the binder and particulate mixture surface. The shaped article remains in the vacuum furnace under these processing parameters until substantially all of the first binder material has transformed to a vapor and diffused through, and from, the shaped article into the furnace environment. After evacuation of the gaseous first binder, the temperature and pressure in the furnace are adjusted to a temperature and pressure sufficient to effect transformation of the second binder material from a solid to a vapor and diffusion of the second binder material as a vapor through, and from, the shaped article without the binder and particulate mixture surface becoming wetted with a liquid phase of the second binder. The binder and particulate mixture is held in the vacuum furnace until substantially all of the second binder material has transformed to a vapor and diffused through the mixture into the furnace environment where it is evacuated. As a result of this process, the shaped article which remains is now completely debindered and can be sintered to impart the desired physical properties.

It is a primary object of the present invention to provide a new and improved method of removing binder material from a binder and particulate mixture.

It is another object of the present invention to provide a method of removing binder material from a binder and particulate mixture which is quick, simple and relatively inexpensive to perform.

It is another object of the present invention to provide a method of removing binder material from a particulate mixture which can be utilized with a plethora of varyingly composed binder materials.

It is another object of the present invention to provide a method of removing binder material from a binder and particulate mixture which does not adversely affect the integrity and chemical composition of the particulate mixture.

It is another object of the present invention to provide a method of removing binder material from a binder and particulate mixture which avoids the formation of the liquid phase of the binder material and the attending expansion forces which can contribute to fracture and cracking of the article.

It is a still further object of the present invention to provide a method of removing binder material from a binder and particulate mixture which is equally effective regardless of the number of different binder materials which are combined with the particulate to form the mixture.

BRIEF DESCRIPTION OF THE DRAWING

These and other details and advantages of the invention will be described in connection with the accompanying drawing in which.

DESCRIPTION OF THE PREFERRED EMBODIMENT

Figure 1:
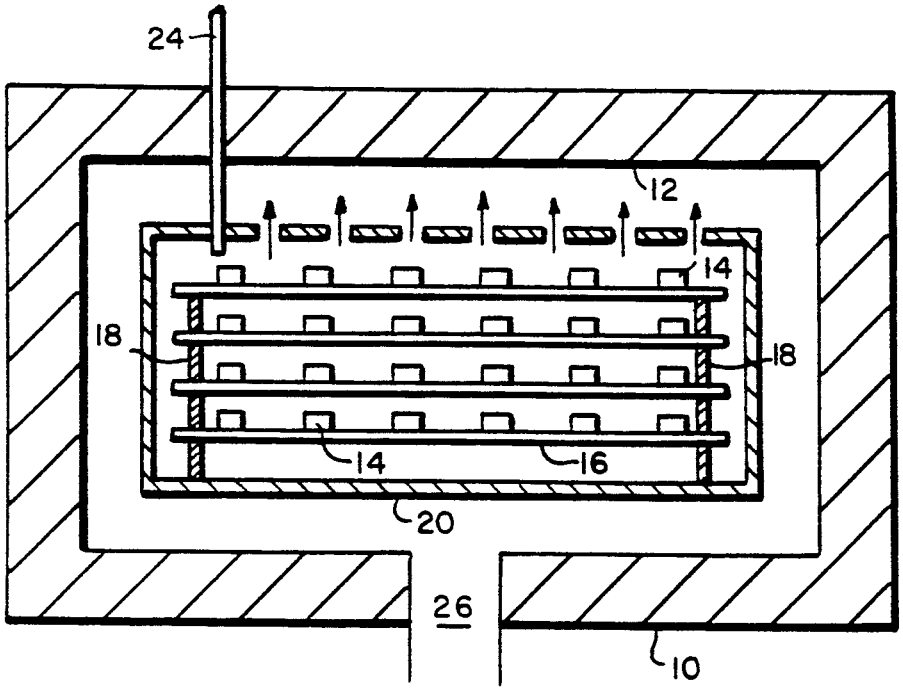
FIG. 1 is a sectional view of the furnace in which shaped article is debindered according to the preferred embodiment of the invention.

At the outset, the invention is described in its broadest overall aspects with a more detailed description following. The present invention is a method of removing binder material from a binder and particulate mixture. Preferably, the binder and particulate mixture has been molded into the form of a shaped article prior to the debindering process. In the preferred embodiment, the binder material consists of a low melting point first binder such as carnauba wax or paraffin and a higher melting point second binder such as polyethylene or polypropylene. The binder material may also include a plasticizer for optimizing the moldability of the mixture or a lubricant or other mold releasing agent for facilitating the release of the green body from the molding apparatus.

The binder material typically constitutes from 6–10% by weight of the binder and particulate mixture. The exact amount of binder material utilized, of course, depends upon the size, shape and porosity of the particulate and the flow properties of the binder and particulate mixture which are necessary for the molding process. The binder should be chemically non-reactive with respect to the particulate material so that no unintended altering of the particulate composition occurs. The binder material must also be non-sublimable at room temperature and pressures greater than 1 Torr to ensure that the binder material remains in the binder and particulate mixture during the molding process and storage of the article so molded thereafter. Although the binder materials utilized in the preferred embodiment include carnauba wax or paraffin and polypropylene or polyethylene, other plastics or polymeric materials can alternatively be used as is known to those skilled in the art.

To form a shaped article of the binder and particulates mixture, a predetermined amount of the first and second binder material is combined with the particulate, which can be a metal, metal alloy, ceramic, cermet or any other material which can be reduced to a particle, to form the desired binder and particulate mixture. Although the binder and particulate mixture is preferably formed into a shaped article by an injection molding process, other methods known to those skilled in the art for forming powder mixtures into shaped parts including compacting, transfer molding or extruding may, of course, alternatively be utilized.

Subsequent to the molding step, sintering of the shaped article is necessary to impart the physical properties, including strength and cohesiveness, required for the shaped article to withstand the stresses of its ultimate application. Prior to this heat treatment, however, the first and second binder materials must be removed from the shaped article since these materials will thermally dissociate prior to sintering into constituents which may combine with the particulate and adversely effect the chemical and physical properties of the sintered product.

To prevent distortion of the shaped article during the binder removal process, it is essential that formation of a surface binder film be avoided. Accordingly, after the binder and particulate mixture has been formed by injection molding into the desired configuration, the shaped article is held in a closed furnace at a pressure and temperature sufficient to effect transformation of the first binder from a solid to a vapor and diffusion of the first binder as a vapor through, and from, the binder and particulate mixture without formation of a liquid phase of the first binder on the shaped article surface. The temperature rise of the shaped article is carefully controlled to ensure that excessive temperature and internal pressure gradients do not develop in the shaped article which can lead to fracture or blister. The shaped article is held in the furnace under these temperature and pressure conditions until substantially all of the first binder has diffused as a vapor through, and from, the shaped article into the closed furnace environment. Because the first binder material is removed from the shaped article as a vapor, the shaped article surface never becomes wetted with a liquid film of binder material, and the associated problem of part distortion is thereby avoided.

To prevent the diffused gaseous first binder material from subsequently combining chemically with the particulate and thereby deleteriously affecting the physical and chemical characteristics of the sintered product, the gaseous first binder material is removed from the closed furnace by any conventional evacuation method which, in the preferred embodiment, includes a diffusion pumping system.

Although the first binder material has been removed, the integrity of the shaped article is still maintained by the higher melting point second binder. In order to remove the second binder material, the temperature and pressure in the closed furnace are adjusted to a temperature and pressure which are sufficient to effect transformation of the second binder material from a solid to a vapor and diffusion of the second binder material as a vapor through, and from, the binder and particulate mixture without formation of a second binder liquid phase on the shaped article surface. The molded article is held in the closed furnace under these processing conditions until substantially all of the second binder material has transformed to a vapor and diffused through the internal matrix of the formed article into the closed furnace environment where it is evacuated through the diffusion pumping system or other suitable means.

It has been found that, during the evacuation step, certain gaseous binder materials will condense in the diffusion pump fluid. The condensed binder material mass and the diffusion pump fluid may combine together to form a coagulation which can impair the efficiency of the pumping system and ultimately render it inoperable. To effectuate the removal of these diffusion pump fluid condensable binder materials, it is therefore preferred that during the removal of the second binder material the diffusion pump be withdrawn from the vacuum exhaust path and the gaseous second binder material be removed through the associated mechanical pump of the diffusion pumping system.

Subsequent to removal of the binder materials, the shaped debindered article may now be sintered. Sintering is preferably accomplished in the same closed furnace in which binder removal occured and may take place immediately subsequent to the debindering operation. The pressure and temperature within the closed vessel must be adjusted, of course, to the proper sintering range. The appropriate combination of sintering pressures and temperatures will depend primarily upon the composition of the particulate, the size, shape and distribution of the particulate material and other sintering variables well known to those skilled in the art. Alternatively, sintering of the debindered article can of course be performed in a separate furnace at a later date if so desired.

The present process for removing binder material from a binder and particulate mixture will accomplish the desired debindering regardless of the number of different types of binders which are incorporated into the particulate mass. Although a two component binder system is utilized in the preferred embodiment, singular or multiple component binder systems consisting of three or more different binders may also be blended with the particulate to form the binder and particulate mixture. The multiple component binder materials are removed by holding the binder and particulate mixture in the closed furnace at a pressure and temperature sufficient to effect transformation of the lowest melting point binder from a solid to a vapor and diffusion of the lowest melting point binder as a vapor through, and from, the shaped article without wetting the binder and particulate surface with a lowest melting point binder liquid phase. When the desired amount of the lowest melting point binder has been removed, the furnace temperature and pressure are adjusted to the temperature and pressure sufficient to effect transformation of the binder with the second lowest melting point from a solid to a vapor and diffusion of the second lowest melting point binder as a vapor through and from the shaped article without formation of a liquid phase of the second lowest melting point binder on the binder and particulate mixture surface.

After the desired amount of the second lowest melting point binder has been removed from the shaped article, the furnace temperature and pressure are again adjusted, this time to the temperature and pressure sufficient to effect removal of the third lowest melting point binder without formation of a liquid phase of the third lowest melting point binder on the binder and particulate mixture surface. The adjusting of the furnace temperature and pressure continues until all of the binder materials which are desired to be removed from the binder and particulate mixture have been transformed to a vapor phase and diffused through the interior channels of the shaped article, and from the article surface, into the closed furnace environment where they are evacuated by the appropriate means. To prevent the formation of temperature gradients in the shaped article all adjustments in furnace temperature are carefully controlled.

Without limiting the scope of the subject matter disclosed herein, applicants suggest that the transformation of the binder material from a solid to a vapor is occuring by a sublimation process. If the phase transformation is by sublimation then the pressure in the furnace which, together with the furnace temperature, is sufficient to effect transformation of the binder material from a solid to a vapor is that pressure which is below the vapor pressure of the binder material at the existing furnace temperature. It therefore follows that by holding a shaped article in a closed furnace at a pressure less than the vapor pressure of the binder material and sufficiently heating the shaped article to drive the removal process, the binder material will sublimate directly from a solid phase to a vapor phase. The sublimated binder material will then diffuse as a vapor through the interstices and channels of the shaped article towards the surface thereof, eventually escaping to the closed furnace environment without having formed an intervening liquid phase on the shaped article surface. It is believed that furnace pressures less than or equal to 0.1 Torr and preferably less than or equal to $5\times10^{-4}$ Torr are sufficiently below the vapor pressures of the binder materials intended for use with the present invention to allow sublimation to take place. It is also anticipated that the temperature sufficient to drive such sublimation processes is between 70° C.–110° C. when paraffin or other waxes are used as the binder material and between 110° C. and 400° C. when polypropylene or other polymers constitute the binder material, although a temperature range between 300° C.–400° C. is thought to be preferable.

In the preferred embodiment, the closed furnace 10 in which the shaped articles are debindered is a Vacuum Industries INJECTA ® vacuum furnace with a resistance heated hot-zone 12. The shaped articles 14 are supported in the hot-zone 12 by nonreactive trays 16, typically alumina or zirconia, which are superposed over one another by spacers 18. A retort 20 encloses the loaded trays 16 providing a shield between the shaped articles 14 and the heating elements. Thermocouple 24, which is connected to the hot zone temperature controller (not shown), ensures that the furnace is operating in the temperature range, sufficient to effect, in conjunction with the furnace pressure, removal of the binder material without wetting the shaped article surface while diffusion pumping system 26 maintains the furnace at the desired vacuum level as well as serving to evacuate the binder vapor from the closed furnace environment.

Figure 2:
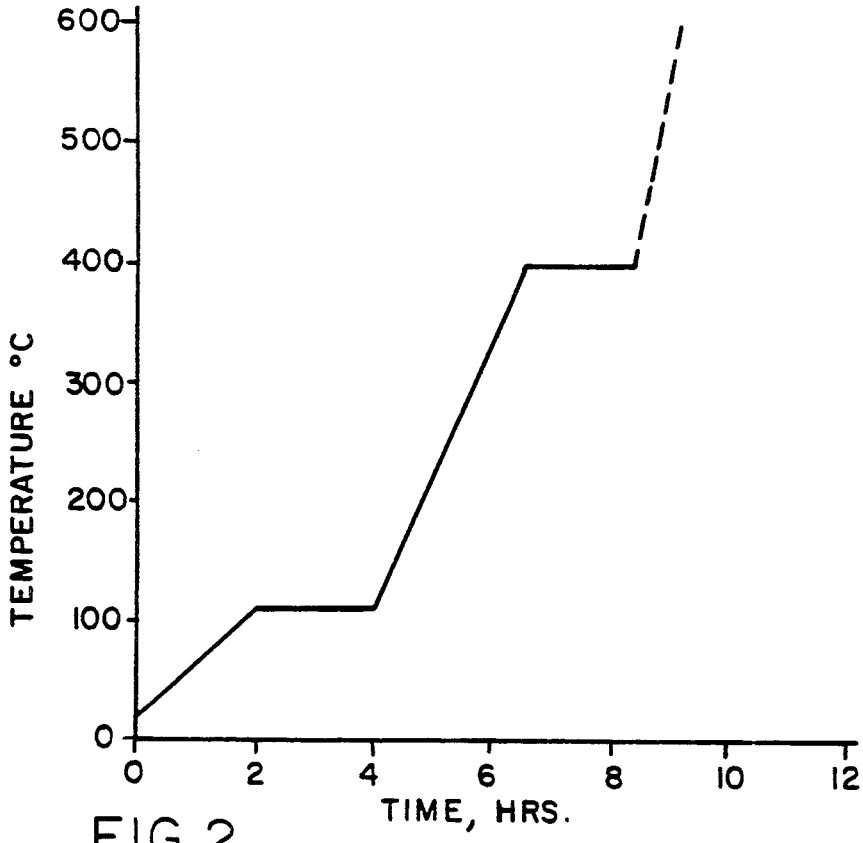
FIG. 2 is a graph illustrating the typical vacuum debindering cycle for a shaped article as a function of time and temperature.

A typical debindering cycle for an injection molded shaped article according to the present invention is illustrated in FIG. 2. After the shaped article, containing 4% by weight paraffin and 3.5% by weight polypropylene, has been placed in the closed furnace, the furnace pressure is pumped down to less than $5\times10^{-4}$ Torr with a diffusion pumping system and the furnace temperature is then carefully raised to 110° C. These processing conditions, which are sufficient to effect removal of the paraffin without the formation of a liquid paraffin phase on the shaped article surface, are maintained for approximately two hours until substantially all of the paraffin has transformed to the vapor phase and diffused through, and from, the shaped article into the closed furnace. The gaseous paraffin is then evacuated through the diffusion pumping system and collected by a condensing system, such as that disclosed in U.S. Pat. No. 4,502,871. The furnace temperature is then raised to 400° C.; the increase in temperature from 110° C. to 400° C. proceeding slowly in order to preserve part integrity. At approximately 350° C., the diffusion pump is taken out of the vacuum exhaust path and is replaced by the associated mechanical pump to facilitate removal of the polypropylene vapor which is condensable in the diffusion pump fluid. The furnace pressure accordingly increases to around 0.1 Torr, the lowest pressure attainable with the mechanical pump, which is still sufficient to effect removal of the polypropylene at 400° C. without coating the shaped article surface with a liquid polypropylene film. The shaped article is held in the closed furnace for approximately two hours until substantially all of the polypropylene has transformed to its vapor phase and diffused through, and from, the shaped article into the closed furnace where it is therefrom removed through the mechanical pump. Once the paraffin and polypropylene binders have been removed, the temperature in the furnace can be raised to the desired sintering range and bonding of the shaped article particulates occurs.

The removal of binder material from a binder and particulate mixture according to the present invention is further exemplified by the following non-limiting examples.

All experiments were performed in a vacuum apparatus consisting of SYSTEM VII ® furnace in combination with a diffusion pumping system and the condensing system disclosed in U.S. Pat. No. 4,502,871. The samples were mixed with the desired amount of binder material, injection molded into simple shapes, placed in the vacuum apparatus, subjected to vacuum pressure conditions and carefully heated according to the following heating cycle.

| °C. | hr. |
|---|---|
| RT-110 | 2 |
| 110 | hold 2 or 4 |
| 110–400 | 2½ |
| 400 | hold 2 or 4 |

The 2% NiFe samples contained 6% by weight paraffin and 2% by weight polyethylene. The 8% NiFe and the 17/4 pH samples contained 4% by weight paraffin and 3.5% by weight polypropylene. Prior to debindering, the binder and particulate mixture samples contained 6–7% by weight carbon. The efficiency of the binder removal process was determined by comparing the carbon content of the particulate prior to addition of the binder material with the carbon content of the sample after the debindering treatment. All carbon content analyses were determined in a LECO® Total Carbon Analyser.

EXAMPLE 1

| Sample | Hold Temp. (°C.) | Hold Temp. (Hours) | Hold Pressure (Torr) | Weight % Carbon Initial | Weight % Carbon Final |
|---|---|---|---|---|---|
| 8% NiFe | 110° C. | 2 | $<5 \times 10^{-4}$ | 0.77 | 0.83 |
| | 400° C. | 2 | $<5 \times 10^{-4}$ | | |
| 2% NiFe | 110° C. | 2 | $<5 \times 10^{-4}$ | 0.78 | 0.80 |
| | 400° C. | 2 | $<5 \times 10^{-4}$ | | |
| 17/4 pH | 110° C. | 2 | $<5 \times 10^{-4}$ | 0.045 | 0.083 |
| | 400° C. | 2 | $<5 \times 10^{-4}$ | | |

EXAMPLE 2

| Sample | Hold Temp. (°C.) | Hold Temp. (Hours) | Hold Pressure (Torr) | Weight % Carbon Initial | Weight % Carbon Final |
|---|---|---|---|---|---|
| 8% NiFe | 110° C. | 4 | <0.1 | 0.77 | 0.83 |
| | 400° C. | 4 | <0.1 | | |
| 2% NiFe | 110° C. | 4 | <0.1 | 0.78 | 0.83 |
| | 400° C. | 4 | <0.1 | | |
| 17/4 pH | 110° C. | 4 | <0.1 | 0.045 | 0.081 |
| | 400° C. | 4 | <0.1 | | |

In the above examples, the initial weight percent carbon content refers to the carbon content of the binder free particulate while the final weight percent carbon content refers to the carbon content of the binder and particulate mixture after debindering. As is clearly evident from the above examples, approximately 99% of the binder material was removed from each of the samples after the debindering treatment.

It is understood that the preceding description is given merely by way of illustration and not in limitation of the invention and that various modifications may be made thereto without departing from the spirit of the invention as claimed.

We claim:

1. A method of removing binder materials from an injection molded shaped article comprising a binder and particulate mixture, wherein the binder materials include at least a first wax binder having a first melting point and a second polymeric binder having a second melting point higher than the first melting point, said method of removing binder materials comprising:

placing the binder and particulate mixture in a closed furnace;

lowering the pressure in the closed furnace with a diffusion pump to a pressure less than or equal to $5 \times 10^{-4}$ Torr;

raising the temperature in the closed furnace to a temperature sufficient to effect transformation of the first binder from a solid to a vapor without decomposition at the pressure of less than or equal to $5 \times 10^{-4}$ Torr and diffusion of the first binder as a vapor through, and from, the binder and particulate mixture without formation of a liquid phase of the first binder on the binder and particulate mixture surface;

holding the binder and particulate mixture in the closed furnace until substantially all of the first binder transforms from a solid to a vapor and diffuses as a vapor through, and from, the binder and particulate mixture into the closed furnace without having formed a liquid phase of first binder on the binder and particulate mixture surface;

evacuating the first binder vapor from the closed furnace through the diffusion pump;

adjusting the pressure in the closed furnace with a mechanical pump to a lowest pressure obtainable in the closed furnace with the mechanical pump;

raising the temperature in the closed furnace to a temperature sufficient to effect transformation of the second binder from a solid to a vapor at the lowest pressure obtainable with the mechanical pump and diffusion of the second binder as a vapor through, and from, the binder and particulate mixture without formation of a liquid phase of second binder on the binder and particulate mixture surface;

holding the binder and particulate mixture in the closed furnace until substantially all of the second binder transforms from a solid to a vapor and diffuses as a vapor through, and from, the binder and particulate mixture into the closed furnace without having formed a liquid phase of second binder on the binder and evacuating the second binder vapor from the closed furnace through the mechanical pump.

* * * * *

UNITED STATES PATENT AND TRADEMARK OFFICE

CERTIFICATE OF CORRECTION

PATENT NO. : 5,122,326

DATED : JUNE 16, 1992

INVENTOR(S) : Martha L. Jackson and Elliot Thompson

It is certified that error appears in the above-indentified patent and that said Letters Patent is hereby corrected as shown below:

Column 1, line 64, after "metal" (second occurrence) but before "materials", insert --alloy--.

Column 2, line 47, after "binder" but before "atmospheric", insert --which is either sublimable at room temperature under normal--.

Column 7, line 53, "INJECTA®" should be --INJECTAVAC®--.

Claim 1, column 10, line 44, after "the binder and", insert --particulate mixture surface; and--.

Claim 1, column 10, line 44, begin a new paragraph for "evacuating the second binder vapor from the closed furnace through the mechanical pump."

Signed and Sealed this

Third Day of May, 1994

Bruce Lehman

*Attest:*

BRUCE LEHMAN

*Attesting Officer*

*Commissioner of Patents and Trademarks*